US007059754B2

(12) United States Patent
Lekson et al.

(10) Patent No.: US 7,059,754 B2
(45) Date of Patent: Jun. 13, 2006

(54) APPARATUS AND METHOD FOR PROVIDING A MODULAR VEHICLE LIGHT DEVICE

(75) Inventors: Matthew Andrew Lekson, Farmington Hills, MI (US); Ben Wang, Northville, MI (US); Dianna Lynn Stadtherr, Livonia, MI (US); Derek Scott Mallory, Plymouth, MI (US); Jianzhong Jiao, Novi, MI (US); Brian Curtis Wells, Grosse Point, MI (US)

(73) Assignee: North American Lighting, Inc., Farmington Hills, MI (US)

( * ) Notice: Subject to any disclaimer, the term of this patent is extended or adjusted under 35 U.S.C. 154(b) by 50 days.

(21) Appl. No.: 10/606,694

(22) Filed: Jun. 25, 2003

(65) Prior Publication Data

US 2004/0125610 A1 Jul. 1, 2004

Related U.S. Application Data

(60) Provisional application No. 60/392,698, filed on Jun. 27, 2002.

(51) Int. Cl.
*F21V 21/00* (2006.01)

(52) U.S. Cl. ..... 362/545; 362/219; 362/238; 362/252; 362/544; 362/800

(58) Field of Classification Search ..... 362/545, 362/544, 800, 219, 238, 252; 340/815.45
See application file for complete search history.

(56) References Cited

U.S. PATENT DOCUMENTS

| | | | | |
|---|---|---|---|---|
| 5,577,832 | A * | 11/1996 | Lodhie | 362/249 |
| 5,806,965 | A * | 9/1998 | Deese | 362/249 |
| 6,422,716 | B1 * | 7/2002 | Henrici et al. | 362/249 |
| 6,474,837 | B1 * | 11/2002 | Belliveau | 362/231 |
| 6,626,557 | B1 * | 9/2003 | Taylor | 362/249 |
| 6,700,502 | B1 * | 3/2004 | Pederson | 340/815.45 |
| 6,789,921 | B1 * | 9/2004 | Deloy et al. | 362/252 |

* cited by examiner

*Primary Examiner*—Sandra O'Shea
*Assistant Examiner*—Anabel Ton
(74) *Attorney, Agent, or Firm*—McDonnell Boehnen Hulbert & Berghoff LLP

(57) ABSTRACT

A modular automotive light device is provided. The light device may include multiple light emitting diodes (LED). Multiple light devices may be arranged in a desired manner comprising an automotive headlamp, for example. The light devices may be stacked on top of each other and/or positioned side by side to form the headlamp. Using multiple light devices provides a sufficient amount of radiated light rays in order to comply with regulations and standards for light output of light devices for use on the exterior of an automobile, for example.

35 Claims, 9 Drawing Sheets

APPARATUS AND METHOD FOR PROVIDING A MODULAR VEHICLE LIGHT DEVICE

PRIORITY

The present patent application claims priority under 35 U.S.C. § 119(e) to U.S. Provisional patent application Ser. No. 60/392,698; filed on Jun. 27, 2002, the full disclosure of which is incorporated herein by reference.

FIELD OF INVENTION

The present invention relates to vehicle light devices and, more particularly, to an apparatus and method for providing a modular vehicle light device.

BACKGROUND OF INVENTION

Generally, an exterior light device on an automotive vehicle provides a visually illuminated field of view for driving or to indicate a braking or turning of an automobile to alert other motorists on the road. A typical light device used to illuminate a field of view is a headlight constructed so that light rays radiated from a light source are reflected off a reflector toward the front of the automotive vehicle as a high beam or a low beam of light. A typical light device used to indicate the braking of an automotive vehicle is a taillamp constructed to direct light rays radiated from a light source toward the rear of the automotive vehicle.

Headlights and taillights of automobiles have different regulations and requirements for performance. For example, a headlight is required to be able to concentrate light onto a desired area, produce a gradient intensity change for efficient visual aiming, and maintain glare light control. Conversely, a taillight may need to meet other light output visibility and size requirements.

To meet these requirements, many light sources may be used to radiate light rays from an automotive light device. For example, an incandescent light bulb, or other light sources as well may be used. However, typical light bulbs have poor power use efficiency and a short lifetime expectancy. As an alternative to incandescent light bulbs, light emitting diode (LED) lamps have also been used in automotive lighting in vehicles such as, cars, motorcycles, forklifts, ATVs, trailers, and other motor vehicles. LEDs can be designed to maximize brightness and fill an entire area of a light fixture according to a desired application. Furthermore, LEDs consume less power and generate less heat, have a longer lifetime, and therefore may be a better choice for automotive light devices.

Typical LED light fixtures comprise numerous LEDs arranged to direct light through the light fixture. For example, a typical fixture may contain six LEDs arranged perpendicular to a lamp base in order to radiate light onto a light fixture reflector and illuminate an entire surface of the fixture. Still other existing designs may use more than 6 LEDs, and/or any number of LEDs within one light fixture to fulfill output requirements. Existing LED lamps that utilize multiple LED light sources to fulfill light output requirements can be difficult to manufacture due to a complexity of a light fixture housing design resulting from numerous LEDs in the same housing and a heat management solution for each. Consequently, it is desirable to provide a light device to overcome these problems.

SUMMARY

In an exemplary embodiment, a stackable vehicle light device is provided. The light device includes a housing, a reflector coupled to the housing and at least one light emitting semiconductor device positioned within the housing. The reflector has a light emitting surface and the light emitting semiconductor device is arranged to emit light rays off the light emitting surface of the reflector. The stackable vehicle light device may be a sub-component of a headlamp, for example. Other examples are possible as well.

In another respect, the exemplary embodiment may take the form of a modular vehicle light device. The modular light device may include a plurality of light modules stackably arranged in a configuration. The light modules may include a housing, a reflector coupled to the housing and at least one light emitting semiconductor device positioned within the housing. The reflector may have a light emitting surface and the light emitting semiconductor device can be arranged to emit light rays off the light emitting surface of the reflector.

In still another respect, the exemplary embodiment may take the form of an automotive headlight. The automotive headlight may include a plurality of modular vehicle light devices stackably arranged in a desired configuration. Each modular vehicle light device may perform as a component of the automotive headlight to provide a lighting arrangement that supplies an ample amount of light. In this manner, a light output that meets regulations and standards set forth for exterior automotive lighting may be provided.

These as well as other features and advantages will become apparent to those of ordinary skill in the art by reading the following detailed description, with appropriate reference to the accompanying drawings.

BRIEF DESCRIPTION OF FIGURES

Reference is made to the attached drawings, wherein like reference numerals refer to like elements throughout, and wherein.

DETAILED DESCRIPTION OF EXEMPLARY EMBODIMENTS

Figure 1A:
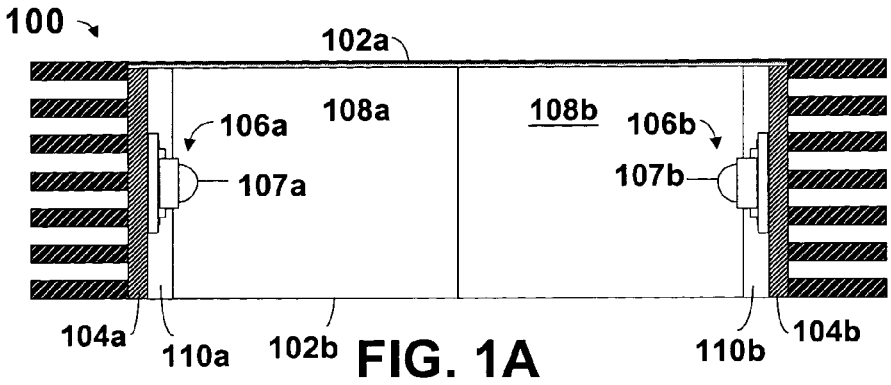
FIG. 1A illustrates a front view of one embodiment of a light device.

A modular automotive light device is provided, that may be used for instance, in automotive light devices, such as a headlamp, a taillamp, a stop lamp, a license plate lamp, a rear end and front end side marker lamp, a fog lamp, an exterior courtesy lamp, or a turn signal lamp, each of which may be mounted at a respective position on an automotive vehicle. Although, those skilled in the art will understand that the light device may be any automotive light device that has any desired configuration and/or stylistic properties.

Referring now to the figures, and more particularly to FIG. 1, a front view of one embodiment of a light device 100 is illustrated. It should be understood that the light device 100 illustrated in FIG. 1 and other arrangements described herein are set forth for purposes of example only, and other arrangements and elements can be used instead and some elements may be omitted altogether, depending on manufacturing and/or consumer preferences.

By way of example, the light device 100 includes a base 102 that has a top 102*a* and a bottom 102*b*, sides 104(*a*–*b*), light sources 106(*a*–*b*), reflectors 108(*a*–*b*), and thermal conductors 110(*a*–*b*). The sides 104(*a*–*b*) are connected to the base 102 opposite each other. The light sources 106(*a*–*b*) are each mounted to the sides 104(*a*–*b*). The reflectors 108(*a*–*b*) may be mounted to the base 102 and/or to the sides 104(*a*–*b*). The thermal conductors (or heat sink) 110(*a*–*b*) may be mounted beneath the light sources 106(*a*–*b*). The light device 100 may have dimensions such as approximately 90 mm by 45 mm, although the light device 100 may be any desired size.

The base 102 may comprise aluminum or a metalized plastic surface. The base 102 may also comprise any material that has a high thermal conductivity. However, other materials may be used as well. The sides 104(*a*–*b*) may comprise the same material as the base 102 or a different material based on a desired application of the light device 100.

The light sources 106(*a*–*b*) may be LEDs or any light emitting semiconductor diode (LESD) where light is produced by a solid-state process or produced from a semiconductor material. The light sources 106(*a*–*b*) have light emitting surfaces 107(*a*–*b*), through which light rays are radiated. Although only two light sources 106(*a*–*b*) are illustrated in FIG. 1A, more or fewer than two light sources may be used per device 100.

The reflectors 108(*a*–*b*) of the light device 100 may comprise any reflective material such as aluminum, a metalized plastic material, or any reflective material. The thermal conductors 110(*a*–*b*) may comprise any material having a high thermal conductivity, such as an aluminum material. The thermal conductors 110(*a*–*b*) may also have fins, as illustrated connected to sides 104(*a*–*b*), that perform as heat sinks to expel heat generated by the light sources 106(*a*–*b*). Also, the thermal conductors 110(*a*–*b*), the base 102, and the sides 104(*a*–*b*) may comprise one integral component.

Figure 1B:
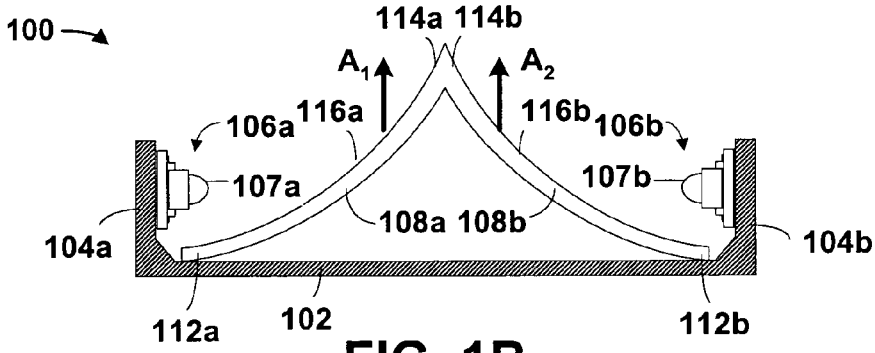
FIG. 1B illustrates a cross-section view of the light device of FIG. 1A.

FIG. 1B illustrates a cross-section view of the light device 100 of FIG. 1A. As shown, the reflectors 108(*a*–*b*) may be formed with any desired curvature. An end 112*a* of reflector 108*a* is mounted to side 104*a* between the light source 106*a* and the base 102. Similarly, an end 112*b* of reflector 108*b* is mounted to side 104*b* between the light source 106*b* and the base 102. Reflectors 108(*a*–*b*) also have second ends 114 (*a*–*b*). The second end 114*a* of reflector 108*a* connects to the second end 114*b* of reflector 108*b* as illustrated in FIG. 1B. Reflectors 108(*a*–*b*) have surfaces 116(*a*–*b*), which may comprise a reflective material and/or a reflective coating. The light sources 106(*a*–*b*) are mounted such that they direct light rays onto the reflectors 108(*a*–*b*). Light rays that are radiated through the light emitting surfaces 107(*a*–*b*) of the light sources 106(*a*–*b*) contact the surfaces 116(*a*–*b*) and are reflected outward in directions indicated by arrows $A_1$ and $A_2$. However, light rays may also be directed outwardly in other directions as well.

Figure 1C:
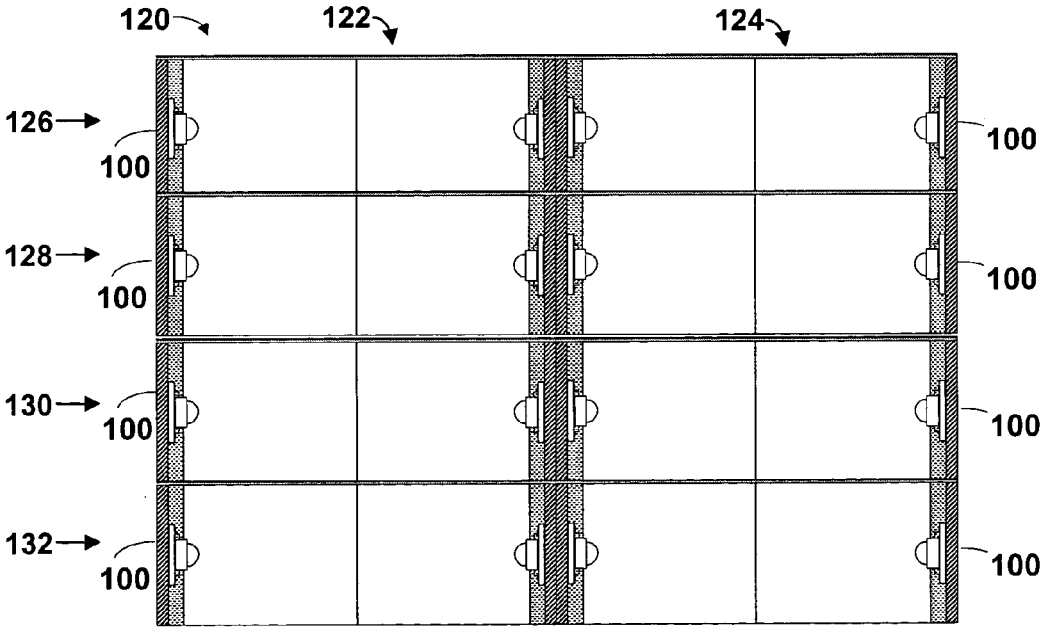
FIG. 1C illustrates a front view of one embodiment of an arrangement of light devices illustrated in FIG. 1A.

FIG. 1C illustrates a front view of one embodiment of an arrangement 120 of the light device 100. The arrangement 120 is illustrated with eight light devices 100, although more or fewer than eight light devices 100 may be used. The light devices 100 are illustrated stacked in columns 122 and 124 on top of each other, such that a bottom of a base 102*b* of one light device 100 contacts a top of a base 102*a* of another light device 100. The arrangement 120 also illustrates light devices 100 positioned in rows 126, 128, 130, and 132, such that a side 104*a* of one light device 100 contacts a side 104*b* of another light device 100. The light devices 100 may be connected in any manner; such as for example, by fastening or snapping into place or by using an adhesive such as glue. The light devices 100 within the arrangement 120 may be positioned and/or arranged in any desired manner. The light devices 100 are modules of the arrangement 120.

The arrangement 120 may comprise a headlamp of a vehicle such as an automobile. Each light device 100 of the arrangement 120 may perform as a miniature headlamp, therefore the arrangement 120 as a whole may perform to meet regulations and standards set forth for exterior automobile lighting. For example, the arrangement 120 may meet the national highway traffic safety administration guidelines, as outlined in the Federal Motor Vehicle Safety Standards (FMVSS) § 571.108, which is entirely incorporated by reference herein, as if fully set forth in this description. FMVSS § 571.108 outlines the national highway traffic safety administration guidelines for many different types of vehicle lighting. As a specific example, for a visual/optical aim headlight system operating as an upper beam, the arrangement 120 may output a light intensity in the range of about 40,000 to about 70,000 Candela along a center horizontal axis. At other viewpoints from the arrangement 120, the light output requirements are less, such as between about 1,000 and about 5,000 Candela, for example. For a visual/optical aim headlight system operating as a lower beam, the light output requirements are less, such as between about 100 and about 10,000 Candela, for example.

As another specific example, the arrangement 120 may be used for a motorcycle lighting system. For motorcycle headlights, a light output of between about 700 and about 10,000 Candela for a lower beam and between about 17,500 and about 75,000 Candela for an upper beam may be required.

The modularization of the light devices 100 allows for any desired lighting design. For example, a headlamp of an automobile may have different light requirements than a tail lamp. Therefore, more or fewer light sources may be required to fulfill the specific lighting requirements. Using the light devices 100, a lighting arrangement can be made that has an ample amount of light sources to provide the required light output. The flexibility of design allows for a flexibility of performance of an arrangement of light devices 100.

Groups of the light devices 100 of the arrangement 120 may each perform different functions. For example, the arrangement 120 may comprise an automotive headlamp and the rows 126 and 128 of light devices 100 may be used for high beam lighting. Conversely, the rows 130 and 132 of light devices 100 may be used for low beam lighting. Other variations exist as well.

To provide a multi-function exterior vehicle light device, each light device within the arrangement 120 may be independently controlled. Alternatively, groups of light devices within the arrangement 120 may be independently controlled. For example, a set of light devices within the arrangement 120 may be controlled together as a group to function as the high beam headlight of a vehicle and another set of the light devices within the arrangement 120 may be controlled together as a group to function as the low beam headlight of a vehicle.

Figure 2A:
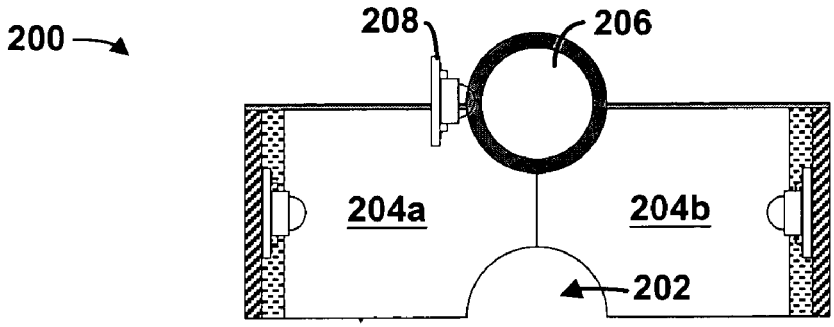
FIG. 2A-2B illustrate front views of alternative embodiments of the light device of FIG. 1A.

FIG. 2A illustrates a front view of another embodiment of a light device 200. The light device 200 may have similar components to the light device 100 illustrated in FIG. 1A, so they will not be described again. However, the light device 200 may additionally and/or alternatively have a cut-out 202 formed within reflectors 204(*a*–*b*), a side reflector 206, and a light source 208 (such as an LED). The cut-out 202 may be a half circle pattern removed from the reflectors 204 (*a*–*b*). However, the cut-out 202 may be any shape desired. The side reflector 204 may be a metalized plastic surface.

The light source 208 may emit light rays that contact the side reflector 206 and reflect substantially perpendicularly outward from the light device 200. Other examples are possible as well.

Figure 2B:
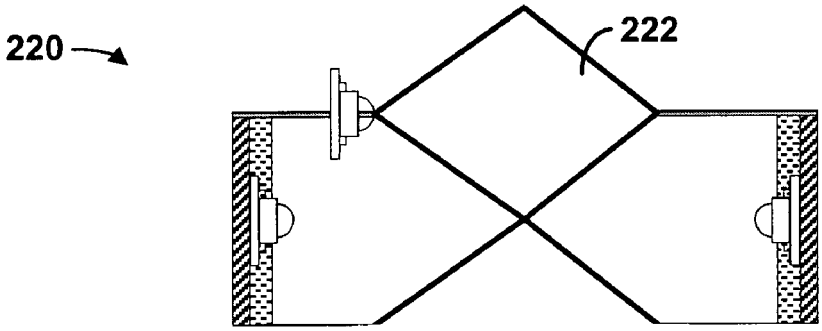

FIG. 2B illustrates a front view of an alternative embodiment of a light device 220. The light device 220 may be substantially the same as light device 200 except that the light device 220 has a diamond side reflector 222. However, the side reflector 222 may be any shape and/or size as desired.

Figure 2C:
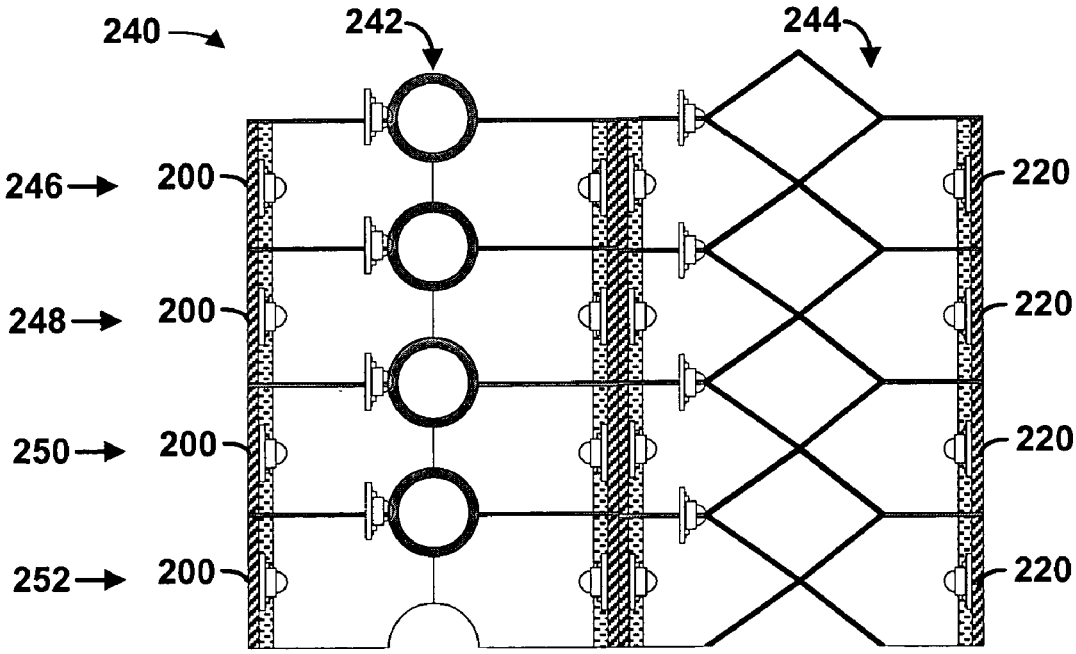
FIG. 2C illustrates a front view of one embodiment of an arrangement of light devices illustrated in FIG. 2A-2B.

FIG. 2C illustrates a front view of one embodiment of an arrangement 240 of the light devices 200 and 220. The arrangement 240 illustrates the light devices 200 positioned in a column 242 and stacked on top of each other. The side reflectors 206 of the light devices 200 may fit into the cut-out 202 of the light device 200 of which it is stacked. The arrangement 240 also illustrates the light devices 220 positioned in a column 244 and stacked on top of each other. The two columns 242 and 244 are positioned side by side to form rows 246, 248, 250, and 252 of light devices, such that one row comprises light device 200 and light device 220. Each of the light devices 200 abuts the light device 220 in the arrangement 240.

Figure 3A:
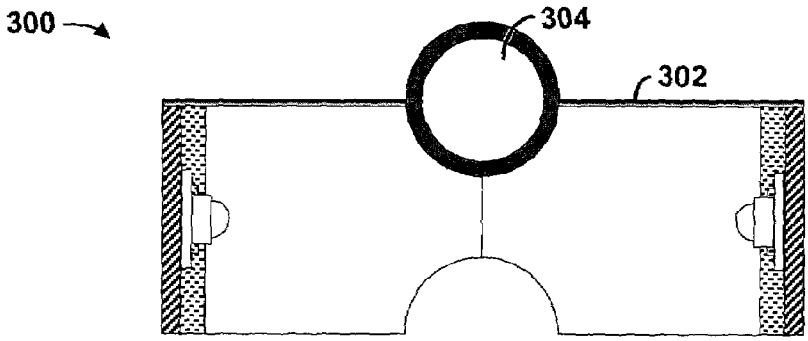
FIG. 3A illustrates a front view of another embodiment of a light device.

FIG. 3A illustrates a front view of another embodiment of a light device 300. The light device 300 may have similar components to the light device 200 illustrated in FIG. 2A, so they will not be described again. However, the light device 300 may additionally and/or alternatively have a base 302 (or a housing structure) and a projector 304. The projector 304 may be positioned at the center of the base 302 and may be integrated as part of the base 302. The projector 304 may comprise glass, plastic, or any other type of transparent material.

The projector 304 may include any form or type of lens as well in order to direct light rays in a desired direction. The projector 304 refracts light rays emitted from the light sources outwardly from the light device 300.

Figure 3B:
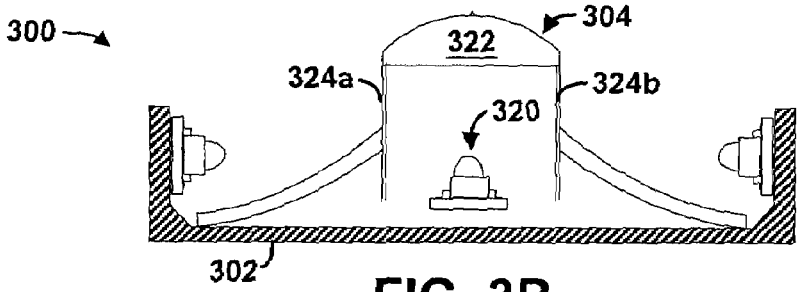
FIG. 3B illustrates a cross-section view of the light device of FIG. 3A.

FIG. 3B illustrates a cross-section view of the light device 300. The light device 300 may include a light source 320. The light device 300 is also illustrated with the projector 304 positioned over the light source 320. The projector 304 may have a lens portion 322 and side portions 324(*a*–*b*). The projector 304 may be positioned such that the light source 320 is near the focal point of the lens 322. Light rays emitted from the light source 320 may propagate through the lens portion 322 and may be directed in any desired manner. The side portions 324(*a*–*b*) may reflect light rays emitted from the light source 320 outwardly in directions comprising 180 degrees in front of the light source 320.

Figure 3C:
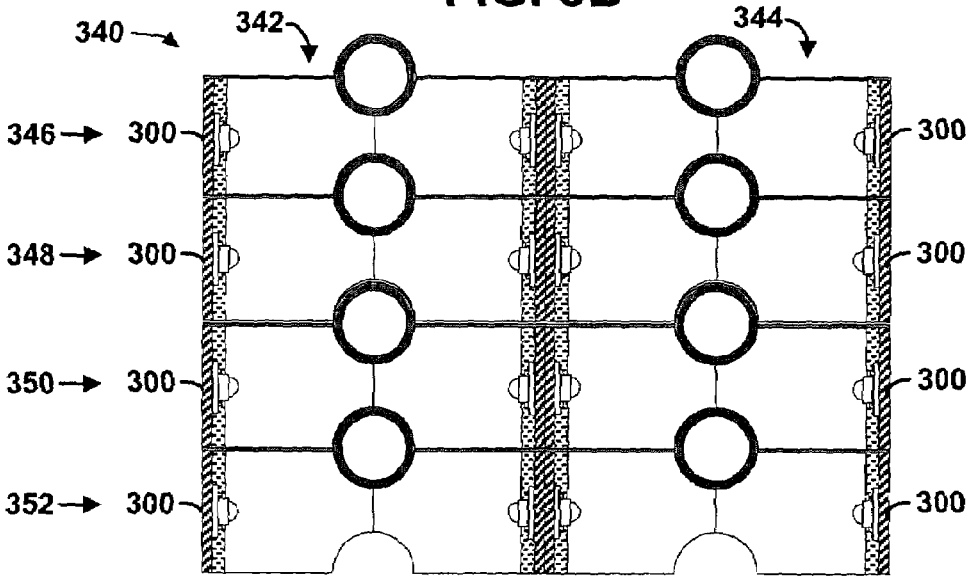
FIG. 3C illustrates a front view of one embodiment of an arrangement of light devices illustrated in FIG. 3A.

FIG. 3C illustrates a front view of one embodiment of an arrangement 340 of the light device 300. The arrangement 340 illustrates the light devices 300 positioned in columns 342 and 344 by stacking them on top of each other. The two columns 342 and 344 are positioned side by side to form rows 346, 348, 350, and 352 of light devices, such that one row comprises two light devices 300.

Figure 4A:
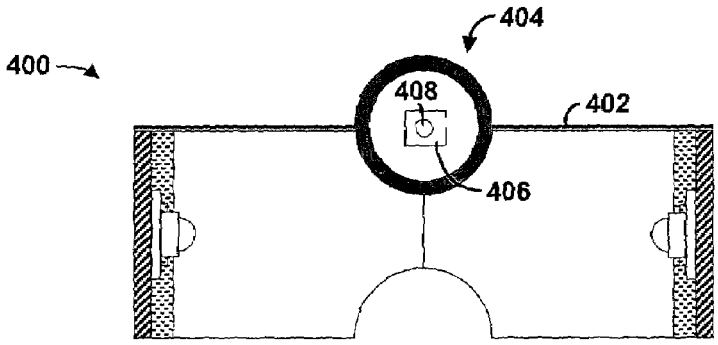
FIG. 4A illustrates a front view of another embodiment of a light device.

FIG. 4A illustrates a front view of another embodiment of a light device 400. The light device 400 may have similar components to the light device 200 illustrated in FIG. 2A, so they will not be described again. However, the light device 400 may additionally and/or alternatively have a base 402, a reflector 404, and a light source 406 with a light emitting surface 408.

The reflector 404 may be any reflecting device. For example, the reflector 404 may be a compound parabolic concentrator (CPC). A compound parabolic concentrator comprises any metalized surface coating or metallic material. The compound parabolic concentrator collects light rays and re-directs the light rays in a desired direction. In addition, the reflector 404 may alternatively comprise solid transparent material. Light emitted from the light emitting surface 408 of the light source 406 may be reflected by the surface 412 via total internal reflection (TIR).

Figure 4B:
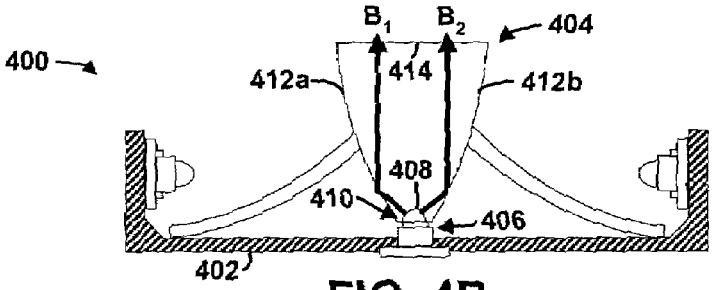
FIG. 4B illustrates a cross-section view of the light device of FIG. 4A.

FIG. 4B illustrates a cross-section view of the light device 400. The reflector 404 has a hole 410 through which the light emitting surface 408 of the light source 406 is positioned. Inner surfaces 412(*a*–*b*) of the reflector 404 may be reflective surfaces and/or have reflective coatings. In addition, the reflector 404 may have a lens 414 or any other type of light focusing or directing mechanism. Light rays emitted from the light emitting surface 408 of the light source 406 may contact the inner surfaces 412(*a*–*b*) and reflect through the lens 414 as illustrated by arrows $B_1$ and $B_2$. However, the light rays may not be reflected directly parallel as shown, therefore, the light rays may be reflected in other manners as well.

Figure 4C:
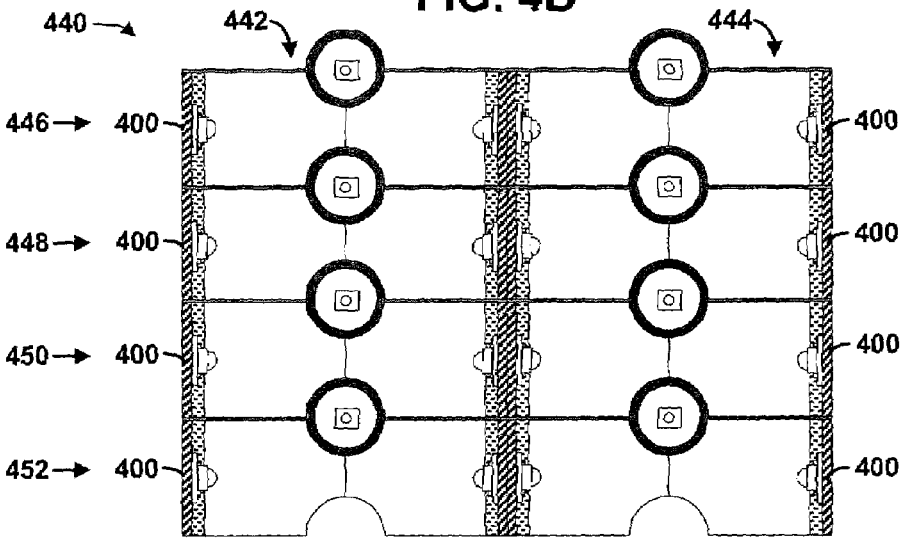
FIG. 4C illustrates a front view of one embodiment of an arrangement of light devices illustrated in FIG. 4A.

FIG. 4C illustrates a front view of one embodiment of an arrangement 440 of the light device 400. The arrangement 440 illustrates the light devices 400 positioned in columns 442 and 444 by stacking them on top of each other. The two columns 442 and 444 are positioned side by side to form rows 446, 448, 450, and 452 of light devices, such that one row comprises two light devices 400.

Figure 5A:
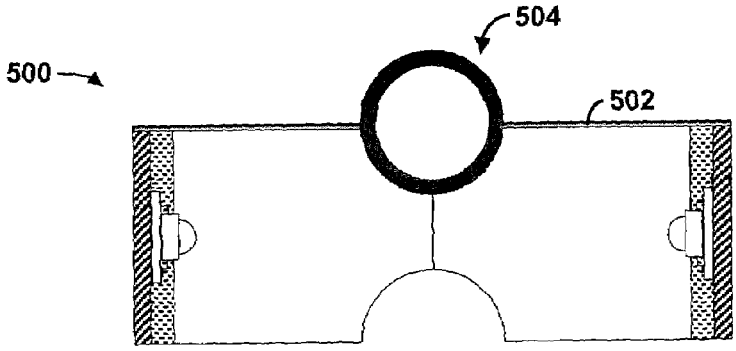
FIG. 5A illustrates a front view of another embodiment of a light device.

FIG. 5A illustrates a front view of another embodiment of a light device 500. The light device 500 may have similar components to the light device 200 illustrated in FIG. 2A, so they will not be described again. However, the light device 500 may additionally and/or alternatively have a base 502 and a projector 504. The projector 504 may be positioned in the center of the base 502. The projector 504 may be a cone projector in order to direct light in a wide range of directions.

Figure 5B:
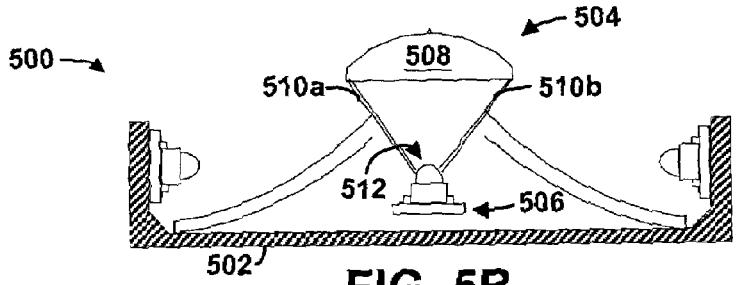
FIG. 5B illustrates a cross-section view of the light device of FIG. 5A.

FIG. 5B illustrates a cross-section view of the light device 500. The light device 500 may have a light source 506 positioned in the center of the base 502. The projector 504 may be positioned near the light source 506 such that the light source 506 is near the focal point of the lens 508. The projector 504 may include a lens portion 508 and side portions 510(*a–b*). The lens portion 508 may have any desired curvature in order to direct light in a wide range of directions. The inner portions 510(*a–b*) may comprise reflective material or may have a reflective coating. The projector 504 may have a hole 512 through which a portion of the light source 506 is positioned. Light rays emitted from the light source 506 may propagate through the lens 508 and be refracted in any desired manner. In addition, the inner portions 510(*a–b*) of the projector 504 may collect light emitted from the light source 506 with larger emitting angles and reflect these light rays through the lens 508.

Figure 5C:
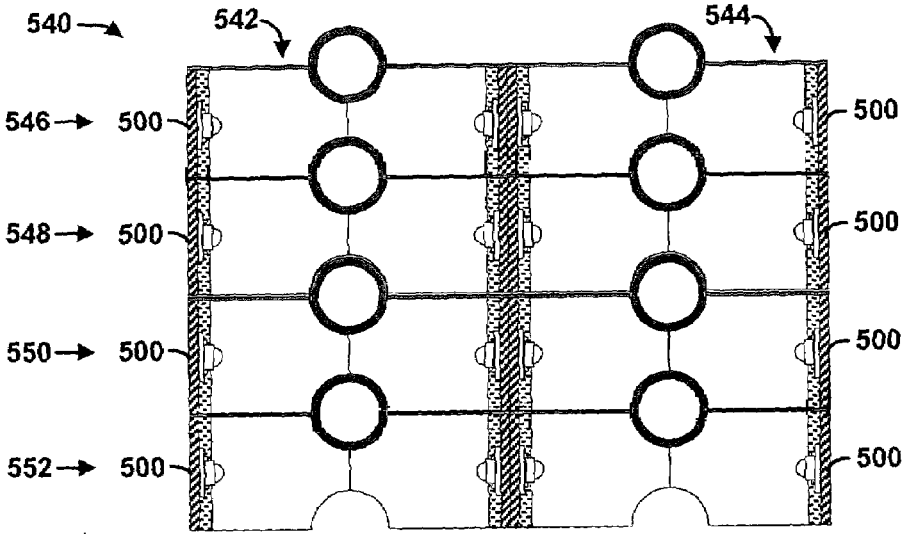
FIG. 5C illustrates a front view of one embodiment of an arrangement of light devices illustrated in FIG. 5A.

FIG. 5C illustrates a front view of one embodiment of an arrangement 540 of the light device 500. The arrangement 540 illustrates the light devices 500 positioned in columns 542 and 544 by stacking them on top of each other. The two columns 542 and 544 are positioned side by side to form rows 546, 548, 550, and 552 of light devices, such that one row comprises two light devices 500.

Figure 6A:
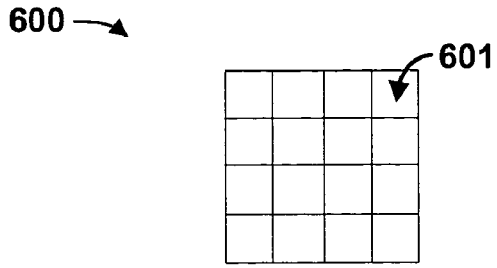
FIG. 6A illustrates a front view of another embodiment of a light device.

FIG. 6A illustrates a front view of another embodiment of a light device lens 600. The light device 600 includes wedges, flutes, or other optical elements 601 on a surface of the light lens. Other optical elements may include Fresnel rings, grooves, or any combination of reflective devices. The optical elements 601 may be formed with spherical, cylindrical, or concentric circles as well.

Figure 6B:
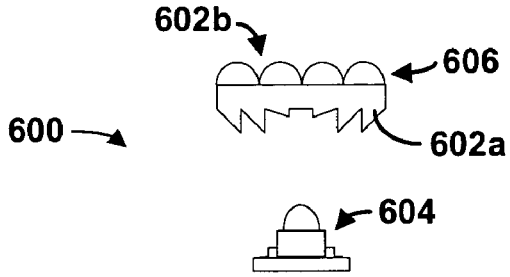
FIG. 6B illustrates a cross-section view of the light device of FIG. 6A.

FIG. 6B illustrates a cross-section view of the light device lens 600. A light source 604 may be positioned near the focal point of a compound Fresnel lens 606. The compound Fresnel lens 606 is illustrated with Fresnel rings or grooves 602(*a–b*) on a bottom of the lens 606, and lentical array (pillows) on the top of the lens bob. The compound Fresnel lens 606 may direct light rays emitted from the light source 604 in a range of directions.

Figure 6C:
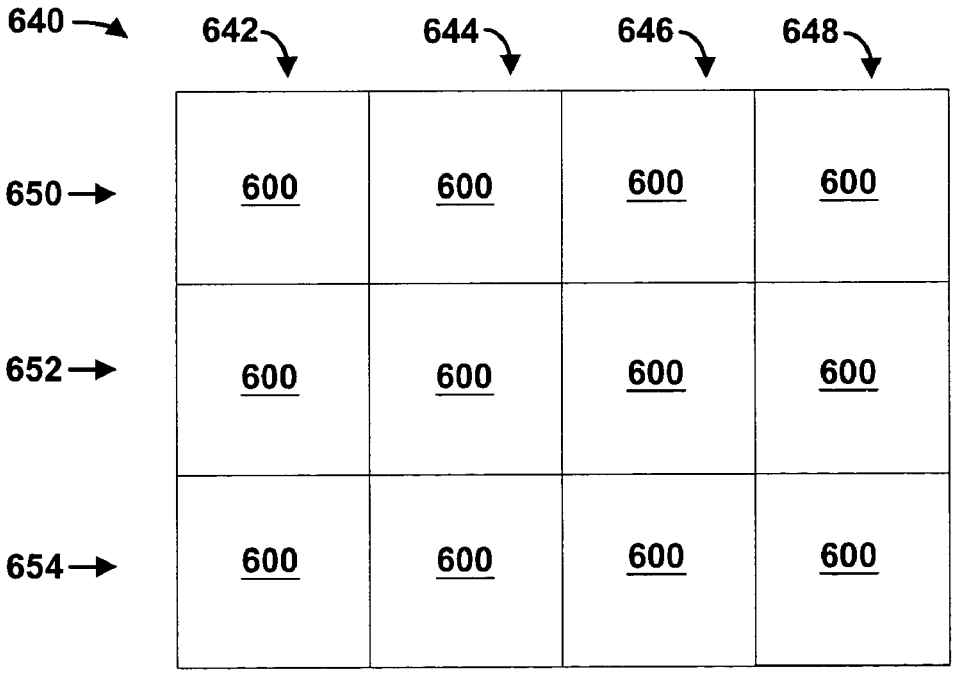
FIG. 6C illustrates a front view of one embodiment of an arrangement of light devices illustrated in FIG. 6A.

FIG. 6C illustrates a front view of one embodiment of an arrangement 640 of the light device lens 600. The arrangement 640 illustrates the light device lens 600 positioned in columns 642, 644, 646, and 648 by stacking them on top of each other. The columns 642, 644, 646, and 648 are positioned side by side to form rows 650, 652, and 654 of light devices, such that one row comprises four light device lens 600.

Figure 7A:
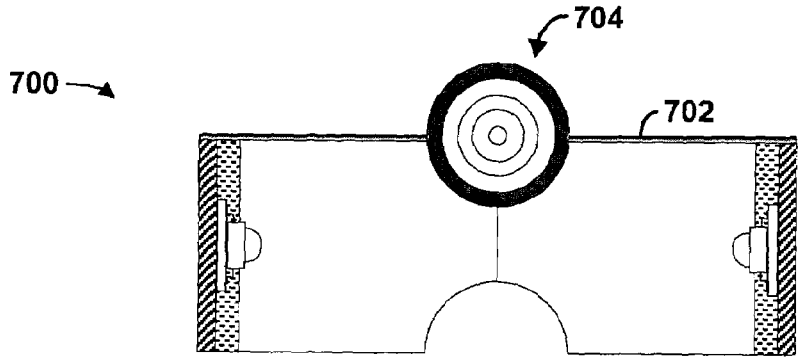
FIG. 7A illustrates a front view of another embodiment of a light device.

FIG. 7A illustrates a front view of another embodiment of a light device 700. The light device 700 may have similar components to the light device 200 illustrated in FIG. 2A, so they will not be described again. However, the light device 700 may additionally and/or alternatively have a base 702 and a Fresnel reflector 704. The Fresnel reflector 704 may be positioned in the center of the base 702.

Figure 7B:
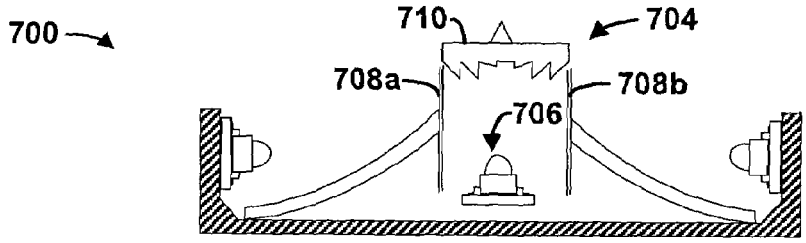
FIG. 7B illustrates a cross-section view of the light device of FIG. 7A.

FIG. 7B illustrates a cross-section view of the light device 700. The light device 700 may also have a light source 706 positioned in the center of the base 702. The light source 706 may be positioned near the focal point of the Fresnel projector 704. The Fresnel projector 704 may be positioned over the light source 706 in order to direct emitted light rays in a wide range of directions. The Fresnel reflector 704 has side portions 708(*a–b*) and a Fresnel lens portion 710. The side portions 708(*a–b*) may comprise reflective materials and/or may have a reflective coating.

In addition, the Fresnel lens portion 710 may have an optical array, such as concentric circles, in order to direct light rays in a wide range of directions. Light rays emitted from the light source 706 may contact the side portions 708(*a–b*) and be reflected through the Fresnel lens portion 710. Alternatively, light rays emitted from the light source 706 may directly contact the Fresnel lens portion 710. The Fresnel lens portion 710 may collect light rays and re-direct them in a desired direction.

Figure 7C:
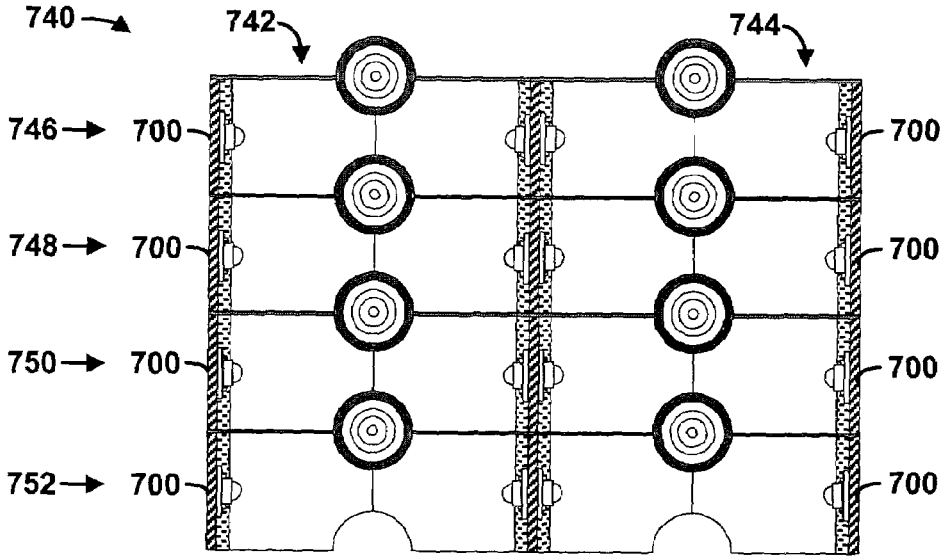
FIG. 7C illustrates a front view of one embodiment of an arrangement of light devices illustrated in FIG. 7A.

FIG. 7C illustrates of front view of one embodiment of an arrangement 740 of the light device 700. The arrangement 740 illustrates the light devices 700 positioned in columns 742 and 744 by stacking them on top of each other. The two columns 742 and 744 are positioned side by side to form rows 746, 748, 750, and 752 of light devices, such that one row comprises two light devices 700.

Figure 8A:
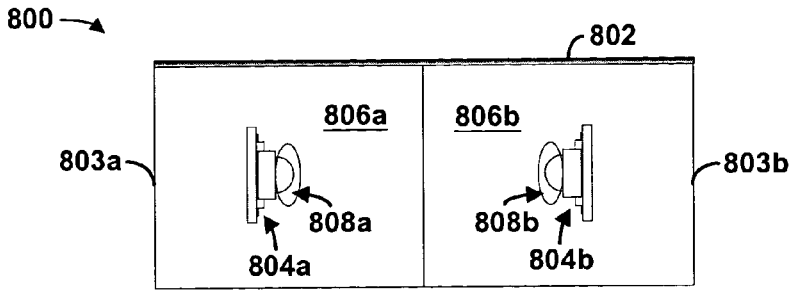
FIG. 8A illustrates a front view of another embodiment of a light device.

FIG. 8A illustrates a front view of another embodiment of a light device 800. The light device 800 may have similar components to the light device 100 illustrated in FIG. 1A, so they will not be described again. However, the light device 800 may additionally and/or alternatively have a base 802 (or a housing structure), sides 803(*a–b*), light sources 804 (*a–b*), reflectors 806(*a–b*), and holes 808(*a–b*) defined through the reflectors 806(*a–b*). The reflectors 806(*a–b*) may be connected to the base 802 and/or the sides 803(*a–b*) of the light device 800. The light sources 804(*a–b*) may be mounted onto the sides 803(*a–b*) of the light device 800 and positioned through the holes 808(*a–b*) of the reflectors 806(*a–b*). The holes 808(*a–b*) may be formed to be similar in shape and size to the light sources 804(*a–b*). The entire light source 804(*a–b*) may be positioned through the hole 808(*a–b*). Alternatively, only a portion of the light source 804(*a–b*) may be positioned through the hole 808(*a–b*).

Figure 8B:
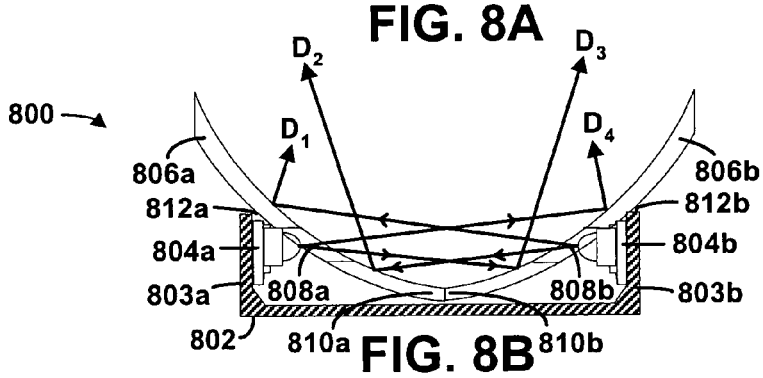
FIG. 8B illustrates a cross-section view of the light device of FIG. 8A.

FIG. 8B illustrates a cross-section view of the light device 800. As shown, the reflectors 806(*a–b*) may be formed to have any desired curvature. The reflectors 806(*a–b*) may have ends 810(*a–b*) which contact each other and connect to the base 802 of the light device 800. The reflectors 806(*a–b*) may have opposite ends 812(*a–b*) that contact and connect to the sides 803(*a–b*). The ends 812(*a–b*) may connect to the sides 803(*a–b*) using an adhesive or any other attachment means.

Light rays emitted from the light sources 804(*a–b*) contact the reflectors 806(*a–b*) opposite the light source and reflect outward. For example, light rays emitted from light source 804*b* contact reflector 806*a* opposite the light source 804*b* and reflect in directions such as those illustrated by arrows $D_1$ and $D_2$. Similarly, light rays emitted from light source 804*a* contact reflector 806*b* opposite the light source 804*a* and reflect in directions such as those illustrated by arrows $D_3$ and $D_4$. However, light rays may be reflected in other directions (not illustrated in FIG. 8B) as well.

Figure 8C:
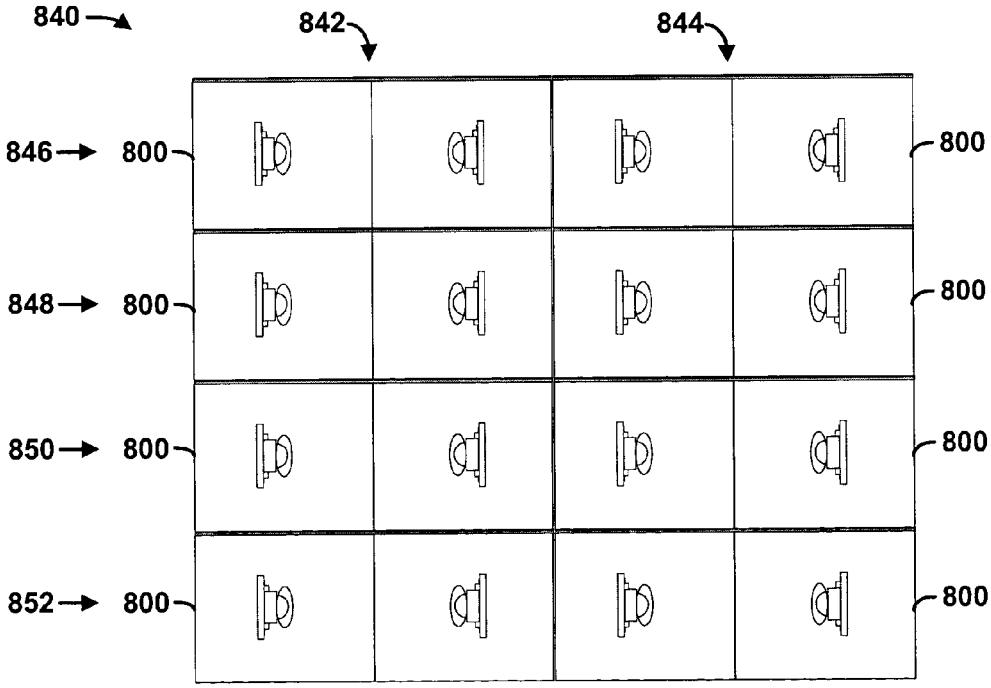
FIG. 8C illustrates a front view of one embodiment of an arrangement of light devices illustrated in FIG. 8A.

FIG. 8C illustrates a front view of one embodiment of an arrangement 840 of the light device 800. The arrangement 840 illustrates the light devices 800 positioned in columns 842 and 844 by stacking them on top of each other. The two columns 842 and 844 are positioned side by side to form rows 846, 848, 850, and 852 of light devices, such that one row comprises two light devices 800.

Figure 9:
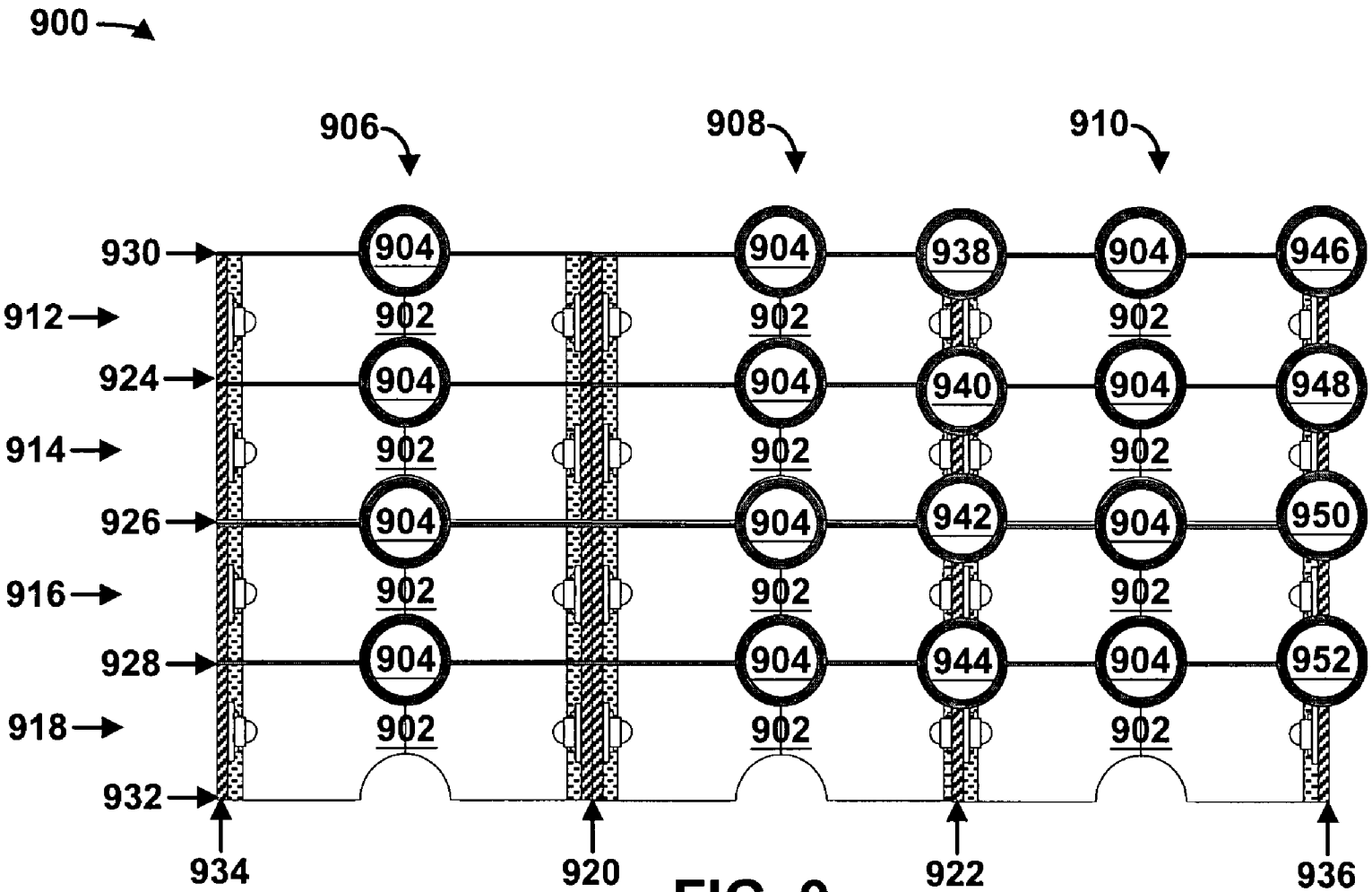
FIG. 9 illustrates a front view of one embodiment of an arrangement of light devices.

FIG. 9 illustrates a front view of another embodiment of an arrangement 900 of light devices 902. The light devices 902 are sub-components of the arrangement 900. The arrangement 900 illustrates the light devices 902, each with a corresponding projector 904 positioned in at the center of the light device 902. The arrangement 900 includes the light device 900 positioned in columns 906, 908, and 910 by stacking them on top of each other. The columns 906, 908, and 910 are positioned side by side to form rows 912, 914, 916, and 918 of light devices, such that one row comprises three light devices 900.

The arrangement 900 comprises a 3×4 matrix of light devices 902. The light devices 902 of the arrangement 900 are positioned such that they are horizontally and vertically in-line with each other. Where the columns 906, 908 and 908, 910 contact, seams 920 and 922 are formed. In addition, where rows 912, 914; 914, 916; and 916, 918 contact, seams 924, 926, and 928 are formed. Also, outer seams 930 and 932 exist along the top and bottom of the arrangement 900, and outer seams 934 and 936 exist along the sides of the arrangement 900. Additional projectors may be mounted along any of the seams 920, 922, 924, 926, 928, 930, 932, 934, and 936. For example, as illustrated in FIG. 9, projector 938 is mounted where seam 930 and seam 922 intersect. FIG. 9 also illustrates additional projectors 940, 942, 944, 946, 948, 950, and 952 mounted at intersections of other seams.

The light devices 902 of the arrangement 900 may be any of the light devices described herein. For example, the light devices may be light device 100, light device 200, light device 300, light device 400, light device 500, light device lens 600, light device 700, or light device 800. In addition, the arrangement 900 may contain any combination and any number of the light devices described herein arranged in any desired configuration. Furthermore, the additional projectors mounted at intersections of seams of the arrangement 900, such as projector 938, may be any of the projectors and/or reflectors described herein. For example, the projector 938 may be projector 304, reflector 404, projector 504, the Fresnel lens 606, and/or the Fresnel reflector 704. Also, any combination of these projectors and reflectors may be used.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims. Consequently, modifications of structure, sequence, materials and the like apparent to those skilled in the art would still fall within the scope of the invention.

For example, while the description of the light devices described herein is focused on stacking light modules in order to form an arrangement of light devices comprising an automotive headlamp, the light devices may be arranged in any manner and/or any desired overall shape. Other examples are possible as well.

We claim:

1. A stackable vehicle light device comprising:

a stackable housing;

a reflector coupled to the stackable housing, the reflector having a light emitting surface; and at least one light emitting semiconductor device positioned within the stackable housing, the at least one light emitting semiconductor device arranged to emit light rays off the light emitting surface of the reflector, wherein the at least one light emitting semiconductor device is a light emitting diode (LED); and at least one connector interconnected with the stackable housing, the at least one connector adapted to interconnect the stackable housing with at least one other stackable housing of another stackable vehicle light device wherein the at least one connector adapted to interconnect the stackable housing with the at least one other stackable housing of another stackable vehicle light device is a connector means selected from the group consisting of a fastener, a snapping mechanism, and an adhesive.

2. The stackable vehicle light device of claim 1, wherein the at least one light emitting semiconductor device is a light emitting diode (LED).

3. The stackable vehicle light device of claim 1, further comprising at least one connector interconnected with the stackable housing, the at least one connector adapted to interconnect the stackable housing with at least one other stackable housing of another stackable vehicle light device.

4. The stackable vehicle light device of claim 1, wherein the at least one connector adapted to interconnect the stackable housing with the at least one other stackable housing of another stackable vehicle light device is a connector means selected from the group consisting of a fastener, a snapping mechanism, and an adhesive.

5. The stackable vehicle light device of claim 1, further comprising at least one thermal conductor positioned within the stackable housing.

6. The stackable vehicle light device of claim 1, wherein the reflector has a first end, a second end, and a curvedly raised portion between the first end and the second end.

7. The stackable vehicle light device of claim 6, wherein the stackable housing has two sides each having an inner surface, and wherein a first light emitting semiconductor device is mounted to the inner surface of one side and a second light emitting semiconductor device is mounted to the inner surface of the other side such that the first and second light emitting semiconductor devices emit light rays toward each other.

8. The stackable vehicle light device of claim 7, wherein the first end of the reflector is coupled to the inner surface of one side of the stackable housing and the second end of the reflector is coupled to the inner surface of the other side of the stackable housing such that the first and second light emitting semiconductor devices emit light rays off the curvedly raised portion.

9. The stackable vehicle light device of claim 1, further comprising a side reflector positioned within a cut-out of the reflector such that the at least one light emitting semiconductor device emits light rays off the side reflector.

10. The stackable vehicle light device of claim 9, wherein the side reflector is a compound parabolic concentrator.

11. The stackable vehicle light device of claim 9, wherein the stackable housing has two sides each having an inner surface and a bottom having an inner surface, and wherein a first light emitting semiconductor device is mounted to the inner surface of one side and a second light emitting semiconductor device is mounted to the inner surface of the other side such that the first and second light emitting semiconductor devices emit light rays toward each other, and wherein a third light emitting semiconductor device is mounted to the inner surface of the bottom.

12. The stackable vehicle light device of claim 11, wherein the side reflector has a cut-out through which a portion of the third light emitting semiconductor device extends.

13. The stackable vehicle light device of claim 1, further comprising a projector coupled to the reflector such that the projector refracts light rays emitted from the at least one light emitting semiconductor device.

14. The stackable vehicle light device of claim 13, wherein the projector includes a lens portion and two side portions, and wherein the projector is positioned such that the light rays emitted from the at least one light semiconductor device propagate through the lens portion.

15. The stackable vehicle light device of claim 13, wherein the projector is a cone projector.

16. The stackable vehicle light device of claim 1, wherein the reflector includes optical elements selected from the group consisting of wedges, flutes, Fresnel rings, and grooves.

17. The stackable vehicle light device of claim 1, wherein the reflector has a first portion, a second portion, and a curvedly lowered portion between the first portion and the second portion.

18. The stackable vehicle light device of claim 17, wherein the stackable housing has two sides each having an inner surface, and wherein a first light emitting semiconductor device is mounted to the inner surface of one side and a second light emitting semiconductor device is mounted to the inner surface of the other side such that the first and second light emitting semiconductor devices emit light rays toward each other, and wherein the first portion of the reflector has a first cut-out through which a portion of the first light emitting semiconductor device extends and the second portion of the reflector has a second cut-out through which a portion of the second light emitting semiconductor device extends.

19. The stackable vehicle light device of claim 18, wherein light rays emitted from the first light emitting semiconductor device reflect off the second portion of the reflector and light rays emitted from the second light emitting semiconductor device reflect off the first portion of the reflector.

20. A modular vehicle light device comprising:

a plurality of light modules stackably arranged in a configuration, the light modules having:

a housing;

a reflector coupled to the housing, the reflector having a light emitting surface; and at least one light emitting semiconductor device positioned within the housing, the at least one light emitting semiconductor device arranged to emit light rays off the light emitting surface of the reflector wherein the modular vehicle light device is a light device selected from the group consisting of as a tail lamp, a stop lamp, a license plate lamp, a headlamp, a fog lamp, an exterior courtesy lamp, and a turn signal lamp and wherein the configuration comprises the plurality of light modules stackably arranged in a matrix.

21. The modular vehicle light device of claim 20, wherein the modular vehicle light device is a light device selected from the group consisting of as a tail lamp, a stop lamp, a license plate lamp, a headlamp, a fog lamp, an exterior courtesy lamp, and a turn signal lamp.

22. The modular vehicle light device of claim 20, wherein the configuration comprises the plurality of light modules stackably arranged in a matrix.

23. The modular vehicle light device of claim 22, wherein the matrix comprises rows and columns, and wherein seams are formed where the rows intersect the columns.

24. The modular vehicle light device of claim 23, further comprising a light element mounted on at least one seam, the light element being selected from the group consisting of a side reflector, a projector, and a Fresnel lens.

25. The modular vehicle light device of claim 20, wherein the configuration comprises the plurality of light modules stackably arranged in a plurality of columns.

26. The modular vehicle light device of claim 25, wherein the plurality of columns are affixed side by side forming a plurality of rows of light modules.

27. The modular vehicle light device of claim 20, wherein each light module has a bottom surface and a top surface, and wherein the plurality of light modules are stacked such that the top surface of a given light module contacts the bottom surface of another given light module.

28. The modular vehicle light device of claim 20, wherein each light module has two side surfaces, and wherein the configuration comprises the plurality of light modules arranged such that one side surface of a given light module contacts one side surface of another given light module.

29. The modular vehicle light device of claim 20, wherein the plurality of light modules comprise a first and a second set of light modules, and wherein the first set of light modules performs a first function and the second set of light modules performs a second function.

30. The modular vehicle light device of claim 29, wherein the first function is high beam head light lighting and the second function is low beam head light lighting.

31. An automotive headlight comprising:

a plurality of modular vehicle light devices being stackably arranged in a desired configuration, wherein each modular vehicle light device performs as a component of the automotive headlight so as to provide a lighting arrangement that supplies an ample amount of light, thereby providing a light output that meets regulations and standards set forth for exterior automotive lighting.

32. A method of providing a multi-function exterior vehicle light device comprising;

stacking a plurality of light modules into a configuration, wherein each light module has:

a housing;

a reflector coupled to the housing, the reflector having a light emitting surface; and at least one light emitting semiconductor device positioned within the housing, the at least one light emitting semiconductor device arranged to emit light rays off the light emitting surface of the reflector; and providing independent control of the light modules of the configuration wherein stacking the plurality of light modules into the configuration comprises stacking the light modules into an automotive headlight configuration.

33. The method of claim 32, wherein stacking the plurality of light modules into the configuration comprises stacking the light modules into an automotive headlight configuration.

34. The method of claim 32, wherein providing independent control of the light modules of the configuration comprises providing control of a first group of light modules being operable to perform a first function and providing control of a second group of light modules being operable to perform a second function.

35. The method of claim 34, wherein the first function is high beam head light lighting and the second function is low beam head light lighting.

* * * * *